United States Patent [19]

Fujikawa et al.

[11] 4,222,360

[45] Sep. 16, 1980

[54] INTERNAL COMBUSTION ENGINE HAVING ENGINE COVER

[75] Inventors: Tetsuzo Fujikawa, Kobe; Shinichi Tamba, Kakogawa; Yoshiteru Ueda, Akashi, all of Japan

[73] Assignee: Kawasaki Jukogyo Kabushiki Kaisha, Hyogo, Japan

[21] Appl. No.: 816,142

[22] Filed: Jul. 15, 1977

[30] Foreign Application Priority Data

Jul. 19, 1976 [JP] Japan ..... 51-86262

[51] Int. Cl.[2] ..... F02F 7/00; F01P 7/02

[52] U.S. Cl. ..... 123/195 C; 123/41.69; 123/41.65

[58] Field of Search ..... 123/195 R, 195 C, 41.6, 123/41.69, 41.65; 165/69

[56] References Cited

U.S. PATENT DOCUMENTS

| | | | |
|---|---|---|---|
| 2,253,025 | 8/1941 | Fedden et al. | 123/41.69 |
| 2,455,708 | 12/1948 | Sherwin | 123/41.69 |
| 3,994,067 | 11/1976 | Hazzard et al. | 123/41.65 |

*Primary Examiner*—Charles J. Myhre
*Assistant Examiner*—Craig R. Feinberg
*Attorney, Agent, or Firm*—Stevens, Davis, Miller & Mosher

[57] ABSTRACT

Internal combustion engine having one or more cylinders and an engine cover encircling the cylinders with a space for defining a cooling air passage therebetween. The engine cover is made of a non-metallic resilient material such as rubber or resinous material and secured to the engine. The engine cover is formed at its inside surface with one or more projections which are adapted to be fitted to the spaces between cylinder cooling fins.

7 Claims, 2 Drawing Figures

INTERNAL COMBUSTION ENGINE HAVING ENGINE COVER

The present invention relates to internal combustion engines and more particularly to internal combustion engines having engine covers attached thereto.

In air-cooled internal combustion engines for snow mobiles and cultivators, it has been common to provide engine covers for the purpose of protecting the engine cylinders. Such engine covers are made of metal sheets and encircle the engine cylinders with cooling air passages defined between the engine cylinders and the engine covers. They are secured to the engines usually by means of bolts or studs.

In known internal combustion engines of this type, it has been experienced that the engine covers vibrate in resonance to the vibration of the engines and produce noticeable noise. Further, cyclic stress possibly applied to the engine cover due to such vibration may decrease the life of the engine cover. Such metal covers are further disadvantageous in that they increase the weights of engines.

The present invention has therefore an object to provide an internal combustion engine having an engine cover which does not produce appreciable noise as in conventional engine covers.

Another object of the present invention is to provide an engine cover which is durable and moreover small in weight.

According to the present invention, the above and other objects can be accomplished by an internal combustion engine comprising crankcase means, cylinder means connected with said crankcase means, piston means disposed in said cylinder means, engine cover means encircling at least a part of said cylinder means and secured to said engine, said engine cover means being made of non-metallic resilient material. According to the present invention, use may be made of rubber material such as nitrile rubber or ethylene-propylene rubber, and resinous material such as polyamide resin and epoxy resin for the engine cover means. Where the present invention is applied to an air-cooled engine, a cooling air passage is defined between the engine cylinder means and the cover means. The cover means may be provided at its inner surface with one or more projections or ridges which may be fitted to the spaces defined between adjacent cooling fins on the cylinder means.

Figure 1:
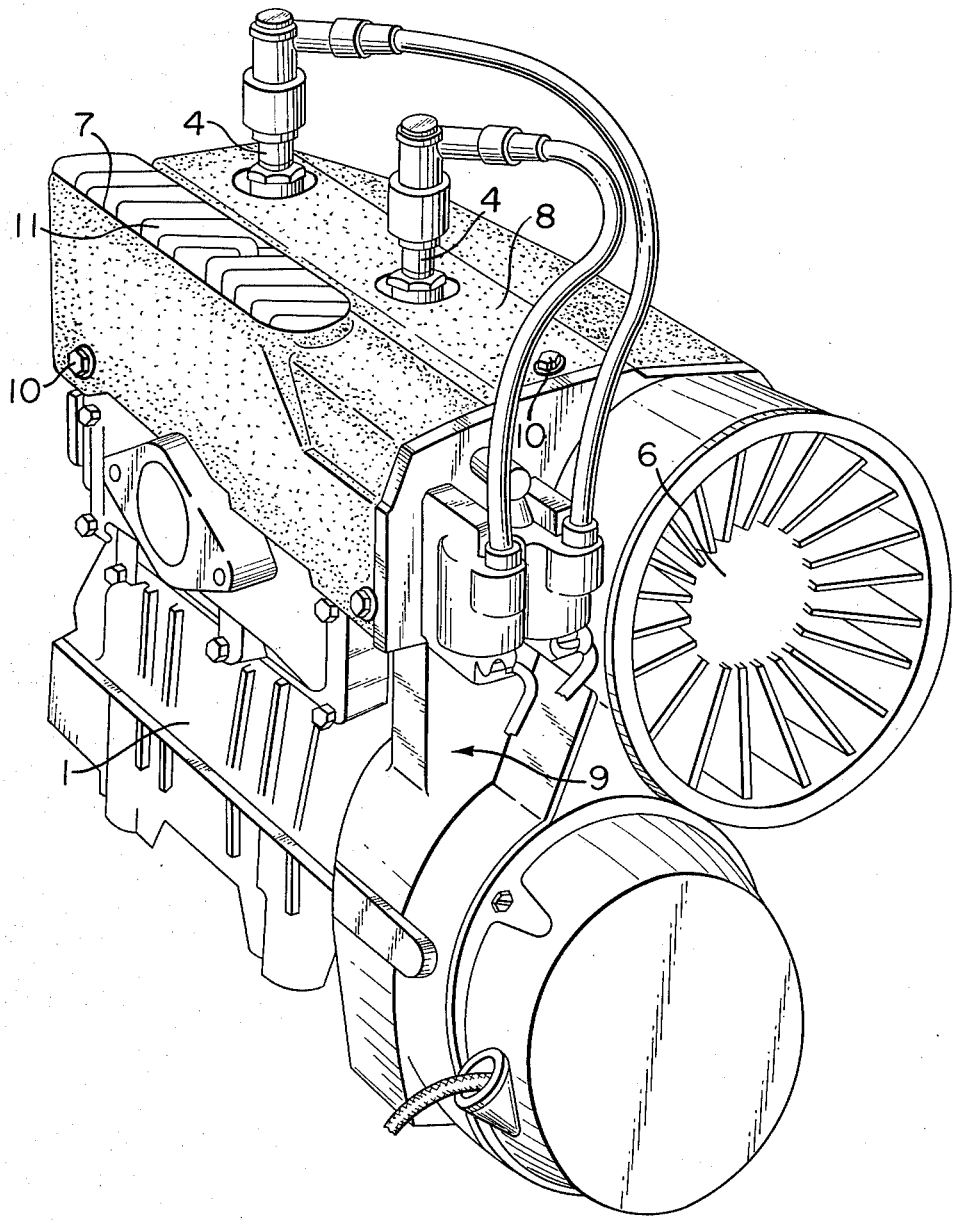
Figure 2:
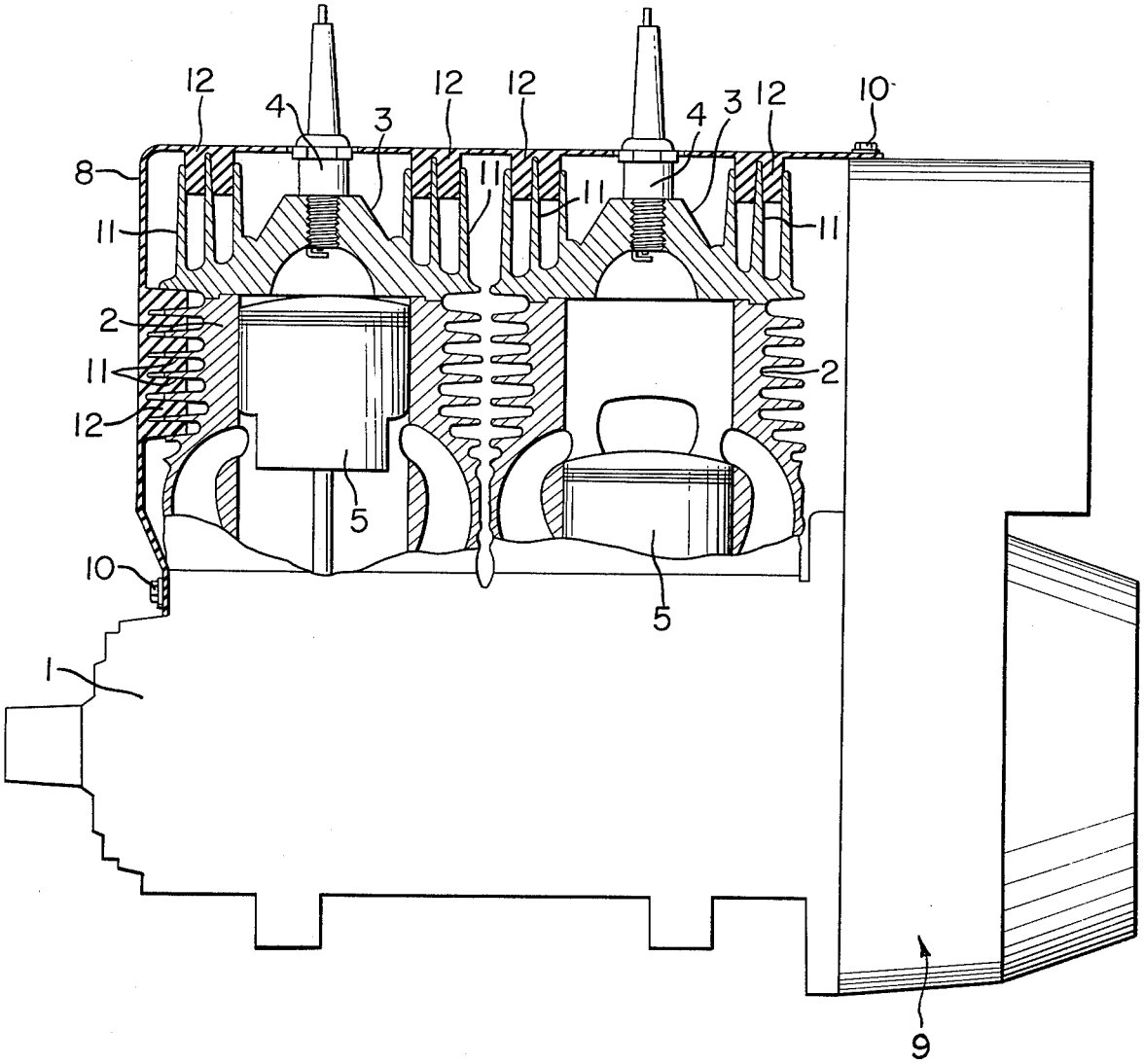

The above and other objects and features of the present invention will become apparent from the following descriptions of a preferred embodiment taking reference to the accompanying drawings, in which:

FIG. 1 is a perspective view of an internal combustion engine in accordance with one embodiment of the present invention; and FIG. 2 is a partially sectioned side view of the engine shown in FIG. 1.

Referring now to the drawings, the engine shown therein includes a crankcase 1 for accommodating a crankshaft (not shown) as well known in the art. On the crankcase 1, there are mounted a plurality of cylinders 2 having cooling fins 11 which may be of conventional form. A cylinder head 3 is secured to each of the cylinders 2 and has a plurality of cooling fins 11. Each cylinder 2 accommodates a piston 5 for reciprocating movement therein and an ignition spark plug 4 is provided on each cylinder head 3. At one side of the crankcase 1, there is provided a starter and fan casing 9.

An engine cover 8 is attached to the engine by means of screws 10 so as to encircle the cylinders 2 and the cylinder heads 3 with spaces between the cover 8 and the cylinders 2 and the cylinder heads 3 for defining a cooling air passage. The engine has a cooling air fan which is disposed in the casing 9 and may be driven by the engine crankshaft through a belt or any other suitable means for blowing air toward the engine cylinders. The engine cover 8 is formed at a portion remote from the fan 6 with a cooling air outlet opening 7.

The engine cover 8 is made of resilient material such as a rubber or a resinous material. The cover 8 has on the inner surface a plurality of projections 12 which are adapted to be fitted to the spaces between the cooling fins 11. Since the engine cover 8 is made of a resilient material, there will be the least possibility of noise being produced through vibrations of the engine cover 8 which may be produced due to resonance of the cover with the vibrations of the engine itself. Further, the inside projections of the cover 8 are fitted to the spaces between the fins 11 on the cylinders 2 and the cylinder heads 3 so that they function as dampers between the engine cover and the fins and firmly hold the engine cover. Since such fin dampers are manufactured integrally with the engine cover, it is possible to decrease the costs for production and for assembling the cover on the engine. The engine cover made of a resilient material is further advantageous over a conventional sheet metal engine cover in respect of weight.

The invention has thus been shown and described with reference to a specific embodiment, however, it should be noted that the invention is in no way limited to the details of the illustrated structures but changes and modifications may be made within the scope of the appended claims.

We claim:

1. An air cooled internal combustion engine comprising crankcase means, cylinder means having horizontally extending outside cooling fins connected with said crankcase means, cylinder head means having vertically extending outside cooling fins connected with said cylinder means, piston means reciprocally mounted in said cylinder means and engine cover means encircling a substantial part of both of said horizontally and vertically extending cooling fins and secured to said engine to define cooling passages between the cover means, the cylinder means and the cylinder head means, said engine cover means being integrally made solely of non-metallic resilient material and having horizontal projection means along its inside side surface to interfit with said horizontal fins and vertical projection means along its inside top surface to interfit with said vertical fins, said cover means having an air intake passage at one end and an air exit passage remotely located therefrom to define said cooling passage means, said cover means acting to suppress vibrations and engine noise.

2. An air cooled internal combustion engine comprising crankcase means, cylinder means having outside cooling fin means connected with said crankcase means, cylinder head means having outside cooling fin means, piston means disposed in said cylinder means, engine cover means encircling a substantial part of both said cylinder and cylinder head cooling fin means and secured to said engine to define cooling passage means between the cover means and the cylinder and the cylinder head means, said engine cover means being integrally made solely of non-metallic resilient material and having projection means along its inside surface interfitted with said cooling fin means to thereby suppress vibrations of the cover means and engine noise.

3. An engine in accordance with claim 2 in which said engine cover means is made of rubber.

4. An engine in accordance with claim 2 in which said engine cover means is made of resinous material.

5. An engine in accordance with claim 1 in which said projection means is fitted to spaces defined in said cooling fin means.

6. An engine in accordance with claim 1 which includes air inlet means for introducing cooling air flow into cooling air passage means defined between said cooling fin means and said engine cover means and having air outlet opening means for allowing the cooling air flow which has passed through the passage means to flow out of the passage means.

7. The engine of claim 6 including fan means in one of said air inlet means and air outlet opening means for forcing air through the cooling air passage means.

* * * * *